US006647640B2

(12) United States Patent
Greive

(10) Patent No.: US 6,647,640 B2
(45) Date of Patent: Nov. 18, 2003

(54) DRYING STATION AND METHOD FOR DRYING PRINTED SHEETS AND PRINTING MACHINE HAVING A DRYING STATION

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/208,467

(22) Filed: Jul. 29, 2002

(65) Prior Publication Data

US 2003/0019126 A1 Jan. 30, 2003

(30) Foreign Application Priority Data

Jul. 27, 2001 (DE) ..... 101 36 745

(51) Int. Cl.[7] ..... F26B 3/00

(52) U.S. Cl. ..... 34/275; 34/308; 34/420; 34/245; 34/307; 34/311; 34/360; 34/367; 34/444

(58) Field of Search ..... 34/245, 255, 259, 34/266, 275, 307, 308, 311, 420, 618, 360, 367, 444; 198/635; 250/455.11, 515.1; 271/179, 272; 347/102

(56) References Cited

U.S. PATENT DOCUMENTS 2,346,880 A * 4/1944 Urbain ..... 250/52
4,363,176 A * 12/1982 Jargiello et al. ..... 34/4
4,594,795 A * 6/1986 Stephansen ..... 34/68
5,154,010 A 10/1992 Klemm
5,831,248 A * 11/1998 Hojyo et al. ..... 219/388
5,896,154 A * 4/1999 Mitani et al. ..... 347/102

FOREIGN PATENT DOCUMENTS

| | | |
|---|---|---|
| DE | 39 10 163 C2 | 10/1990 |
| DE | 39 36 958 C2 | 5/1991 |
| DE | 41 39 120 A1 | 6/1992 |
| DE | 44 17 784 A1 | 11/1995 |
| DE | 44 42 557 A1 | 6/1996 |

* cited by examiner

*Primary Examiner*—Ira S. Lazarus
*Assistant Examiner*—K. B. Rinehart
(74) *Attorney, Agent, or Firm*—Laurence A. Greenberg; Werner H. Stemer; Gregory L. Mayback

(57) ABSTRACT

A drying station for drying printed sheets transported by a transport belt includes an irradiation device for irradiating the printed sheets, a deflection section located in vicinity of the irradiation device for guiding the transport belt away from the irradiation device, and a shielding device disposed between the transport belt and the irradiation device for shielding the transport belt against radiation from the irradiation device while the sheets are exposed to the radiation. A printing machine including the drying station and a method for drying printed sheets are also provided.

17 Claims, 6 Drawing Sheets

DRYING STATION AND METHOD FOR DRYING PRINTED SHEETS AND PRINTING MACHINE HAVING A DRYING STATION

BACKGROUND OF THE INVENTION

Field of the Invention

The invention relates to a drying station for drying printed sheets and a drying method for use in such a drying station.

In printing processes, it is generally desirable to dry the printing ink applied to the printing material as quickly as possible, in order to avoid smudging. In connection therewith, it has already become known heretofore to accelerate the drying method by irradiation, in particular with ultraviolet or UV light. Although this procedure delivers very good results with regard to the drying, it also entails disadvantages, in particular when printing sheets. The sheets are conveyed past the irradiation device, such as a UV radiator, for example by a transport belt. This causes the transport belt to be exposed to irradiation with UV light in the context of the drying process, because the sheets do not cover the transport belt completely. With regard to plastic material from which the transport belt is generally produced, the action of the UV radiation causes accelerated aging, i.e., the lifespan of the transport belt is reduced, so that the transport belt has to be replaced prematurely. Due to the shortened time interval before the transport belt has to be replaced, higher maintenance costs arise, and the number of machine stoppages is increased.

In order to reduce the UV loading of the transport belt, it would be possible to try to operate the irradiation device cyclically, so that irradiation is performed only when a sheet is just being guided past the irradiation device. In contrast, when the gaps present between successive sheets pass the irradiation device, the irradiation device is switched off. This procedure has a drawback, however, in that switching the irradiation device on and off is very complicated in technical terms and would have to be synchronized very precisely with the sheet transport. Furthermore, the irradiation device would have to be focused very precisely parallel to the direction of movement of the transport belt, on the one hand, to ensure complete irradiation of the printed region of the sheets and, on the other hand, to prevent undesired irradiation of the transport belt as completely as possible.

In principle, it is also possible to produce the transport belt from a material which is not impaired by the UV radiation, or impaired thereby only to a tolerable extent. For example, a metal fabric could be used. This has a disadvantage, however, in that the use of such materials entails very high costs, and/or the characteristics of the plastic materials which are to be replaced by these metal materials can be simulated only rather inadequately.

SUMMARY OF THE INVENTION

It is therefore an object of the invention to permit, with a tolerable expenditure, the application of irradiation techniques for accelerating drying in the case of sheets which are conveyed by a transport belt, and more specifically, to provide a drying station and a method for drying printed sheets and a printing machine having a drying station.

With the foregoing and other objects in view, there is provided, in accordance with one aspect of the invention, a drying station for drying printed sheets transported by a transport belt, comprising an irradiation device for irradiating the printed sheets, a deflection section located in vicinity of the irradiation device for guiding the transport belt away from the irradiation device, and a shielding device disposed between the transport belt and the irradiation device for shielding the transport belt against radiation from the irradiation device while the sheets are exposed to the radiation.

In accordance with another feature of the invention, the deflection section has such dimensions that the sheets are lifted off the transport belt, at least in some regions, at a beginning of the deflection section.

In accordance with a further feature of the invention, the shielding device is formed with a chamfer.

In accordance with an added feature of the invention, the drying station further comprises devices for guiding and for transporting the sheets, the guiding and the transporting devices being disposed on a side of the shielding device facing towards the irradiation device.

In accordance with an additional feature of the invention, the drying station further comprises blower nozzles disposed on the shielding device for guiding and for transporting the sheets.

In accordance with yet another feature of the invention, the drying station further comprises air ducts disposed in the shielding device and serving for supplying air to the blower nozzles.

In accordance with yet a further feature of the invention, the drying station further comprises cooling ducts disposed in the shielding device and being traversible by a coolant flow.

In accordance with yet an added feature of the invention, the shielding device has a plate-like construction.

In accordance with yet an additional feature of the invention, the shielding device is formed of three layers made up of a first layer facing towards the irradiation device, and being provided with blower nozzles and cooling ducts, a succeeding second layer serving as a closure plate for the cooling ducts which are open towards the second layer, and a third layer provided with air ducts therein which open towards the second layer.

In accordance with still another feature of the invention, the second layer of the shielding device is formed with boreholes through which air is able to pass from the air ducts of the third layer to the blower nozzles of the first layer.

In accordance with still a further feature of the invention, the drying station further comprises at least three deflection rollers disposed in the deflection section.

In accordance with still an added feature of the invention, the irradiation source is a UV radiator.

In accordance with another aspect of the invention, there is provided a printing machine having a drying station for drying printed sheets transported by a transport belt, comprising an irradiation device for irradiating the printed sheets, a deflection section located in vicinity of the irradiation device for guiding the transport belt away from the irradiation device, and a shielding device disposed between the transport belt and the irradiation device for shielding the transport belt against radiation from the irradiation device while the sheets are exposed to the radiation.

In accordance with a further aspect of the invention, there is provided a method for drying printed sheets, which comprises conveying the sheets by a transport belt into the vicinity of an irradiation device, and subjecting the sheets to irradiation in order to accelerate drying thereof, and further comprising separating the sheets from the transport belt, at least in some regions, before the sheets are guided past the irradiation device, guiding the transport belt, on the one hand, and the sheets, on the other hand, past the irradiation device separated from one another, and subjecting only the sheets to the irradiation, while shielding the transport belt from the irradiation.

In accordance with an added mode, the method of the invention further comprises, in the vicinity of the irradiation device, guiding the transport belt over a deflection section.

In accordance with an additional mode, the method of the invention further comprises, in the vicinity of the irradiation device, guiding the sheets over a shielding device which serves for shielding the transport belt from the irradiation.

In accordance with a concomitant mode, the method of the invention further comprises guiding the transport belt and the sheets together again after passing the irradiation device.

The drying station according to the invention for drying printed sheets which are transported by a transport belt thus has an irradiation device for irradiating the sheets. Arranged in vicinity of the irradiation device is a deflection section, which guides the transport belt away from the irradiation device. Arranged between the transport belt and the irradiation device is a shielding device, which shields the transport belt against the radiation from the irradiation device without shielding the sheets therefrom.

This arrangement offers the advantage that the radiation acts upon the sheets and, as a result, very quickly dries the printing ink applied to the sheets. At the same time, the transport belt is prevented from likewise being exposed to the irradiation with consequent triggering of undesired aging effects. It is thereby possible, with regard to the transport or conveyor belt, to have recourse to a tried and tested plastic belt while, nevertheless, utilizing the advantages of accelerating the drying by irradiation.

The deflection section is advantageously dimensioned so that the sheets, due to the stiffness thereof, are lifted off the transport belt, at least in some regions, at the beginning of the deflection section. An added device for separating the sheets from the transport belt is therefore not required.

In order to facilitate the transfer of the sheets from the transport belt to the shielding device, it is advantageous if the shielding device is formed with a chamfer in the region thereof wherein the sheets engage or make contact with the shielding device.

It is possible to dispense with a separate device for guiding and for transporting the sheets in the region or vicinity of the irradiation device, because these functions can also be performed by the shielding device.

In the region or vicinity of the shielding device, the guidance and the transport of the sheets are performed by blower nozzles. These can be implemented or realized with little effort, and operate very reliably, because there are no moving parts. Only a compressed-air connection is necessary. Within the shielding device, the air is supplied to the blower nozzles via air ducts.

In addition to the air ducts, the shielding device also has cooling ducts, through which a coolant flows, so that a constant temperature of the shielding device is assured. This offers the advantage that the shielding device, in addition to the shielding function thereof, also prevents impermissible heating of the sheets and of the transport belt. As a result, an irradiation device with a high power density can be used, which permits a high throughput.

In a preferred exemplary embodiment, the shielding device is of plate-like construction and is formed with three layers, namely, a first layer which faces towards the irradiation device provided with the blower nozzles and the cooling ducts. A succeeding second layer serves as a closure plate for the cooling ducts of the first layer, which open towards the second layer. A third layer has the air ducts therein which open towards the second layer. In addition, the second layer is formed with boreholes through which air passes from the air ducts of the third layer to the blower nozzles of the first layer. This construction has the advantage that it may be produced with a tolerable expenditure and, if the mutually joined individual layers are separable, the air ducts and the cooling ducts are very easily accessible for maintenance work.

In the preferred embodiment, the deflection section has three deflection rollers. However, there may also be more deflection rollers, depending upon the conditions of the respective application thereof.

The radiation source is preferably constructed as an ultraviolet or UV radiator, because a wide spectrum or range of UV-curing printing inks is available and the drying takes place very quickly.

In the method according to the invention for drying printed sheets, the sheets are transported into the vicinity of an irradiation device by a transport belt. Before the sheets are guided past the irradiation device, they are separated, at least in some regions thereof, from the transport belt. The transport belt and the sheets are guided past the irradiation device separated from one another, and only the sheets, but not the transport belt, are subjected to the irradiation.

The separate handling of the sheets offers the advantage that the transport belt can be protected very reliably against the action of the irradiation.

In the vicinity or region of the radiation device, the transport belt is guided over a deflection section. This offers the advantage that the transport belt is guided past the radiation source at a greater distance therefrom than the sheets, and that space for the installation of further components is created.

Because the transport belt and the sheets are guided together again after passing the irradiation device, the flow of the method is not interrupted, in spite of the separate handling of the sheets in the vicinity or region of the irradiation device.

Other features which are considered as characteristic for the invention are set forth in the appended claims.

Although the invention is illustrated and described herein as embodied in a drying station and a method for drying printed sheets and a printing machine having a drying station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

A common factor in all the figures, is that the same exemplary embodiment of the drying station according to the invention is illustrated therein. The individual figures, respectively, differ only in the type of view.

Figure 1:
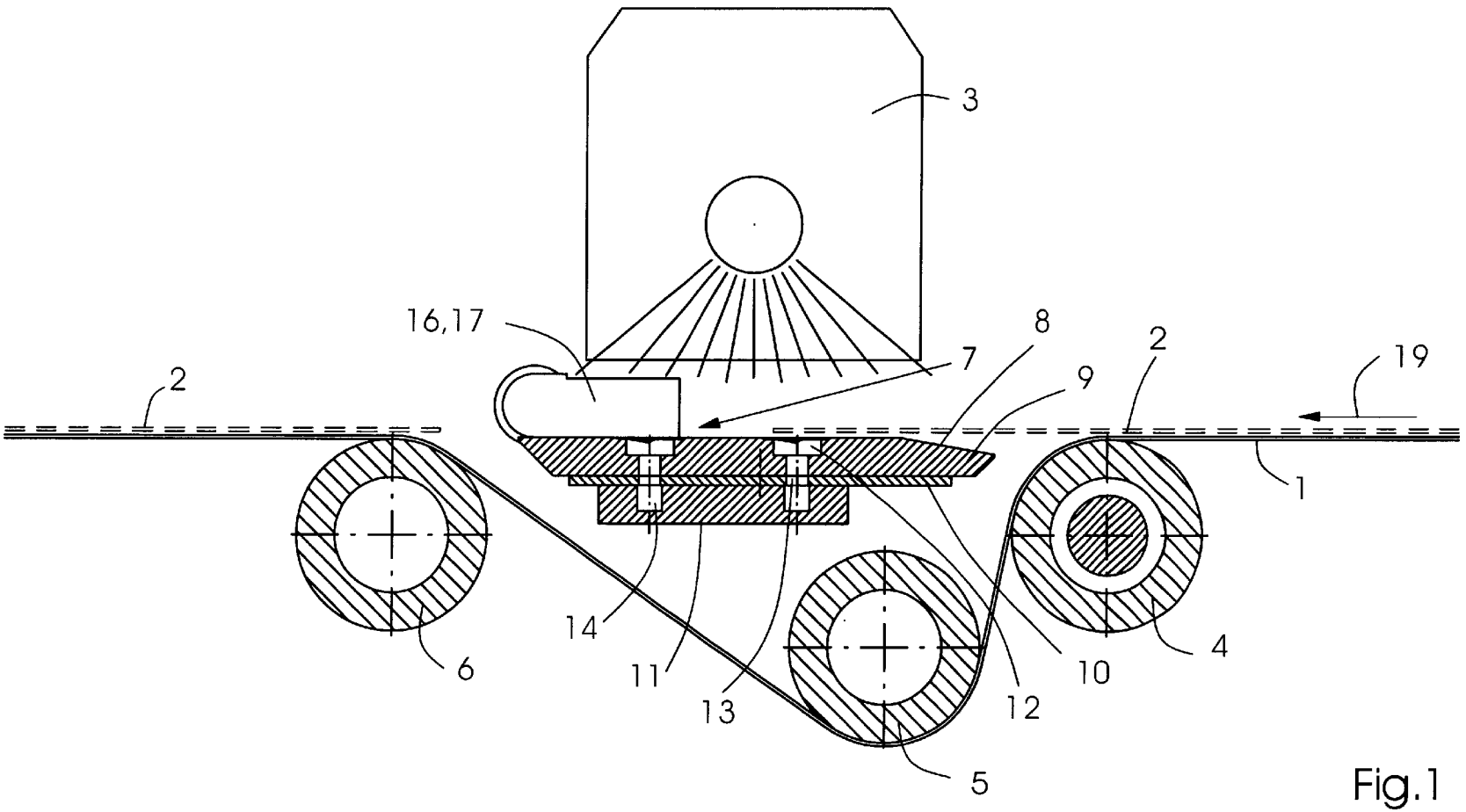
FIG. 1 is a diagrammatic longitudinal sectional view of a drying station according to the invention.
Figure 2:
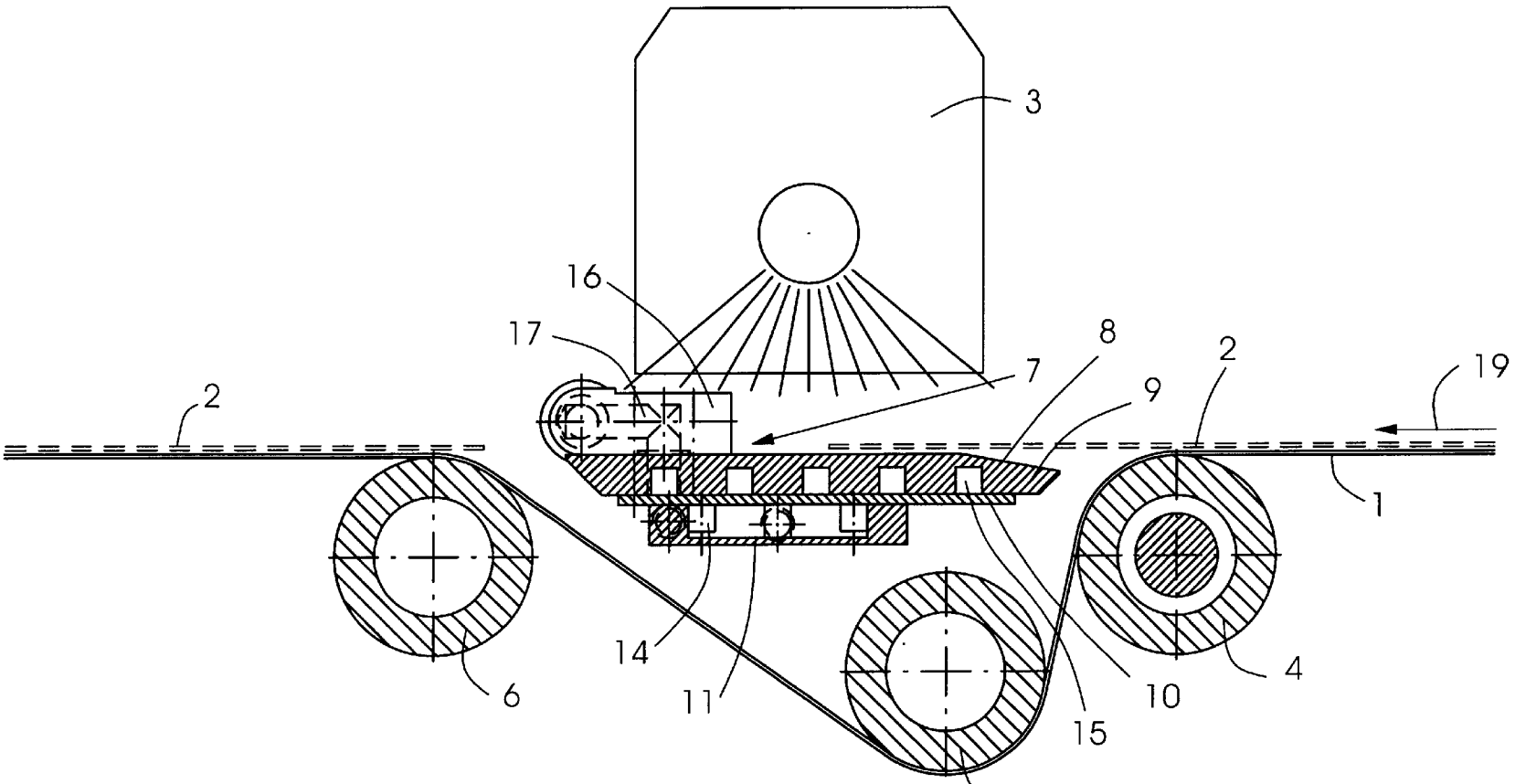
FIG. 2 is a diagrammatic longitudinal sectional view of the drying station taken along a plane parallel to the sectional plane illustrated in FIG. 1.
Figure 3:
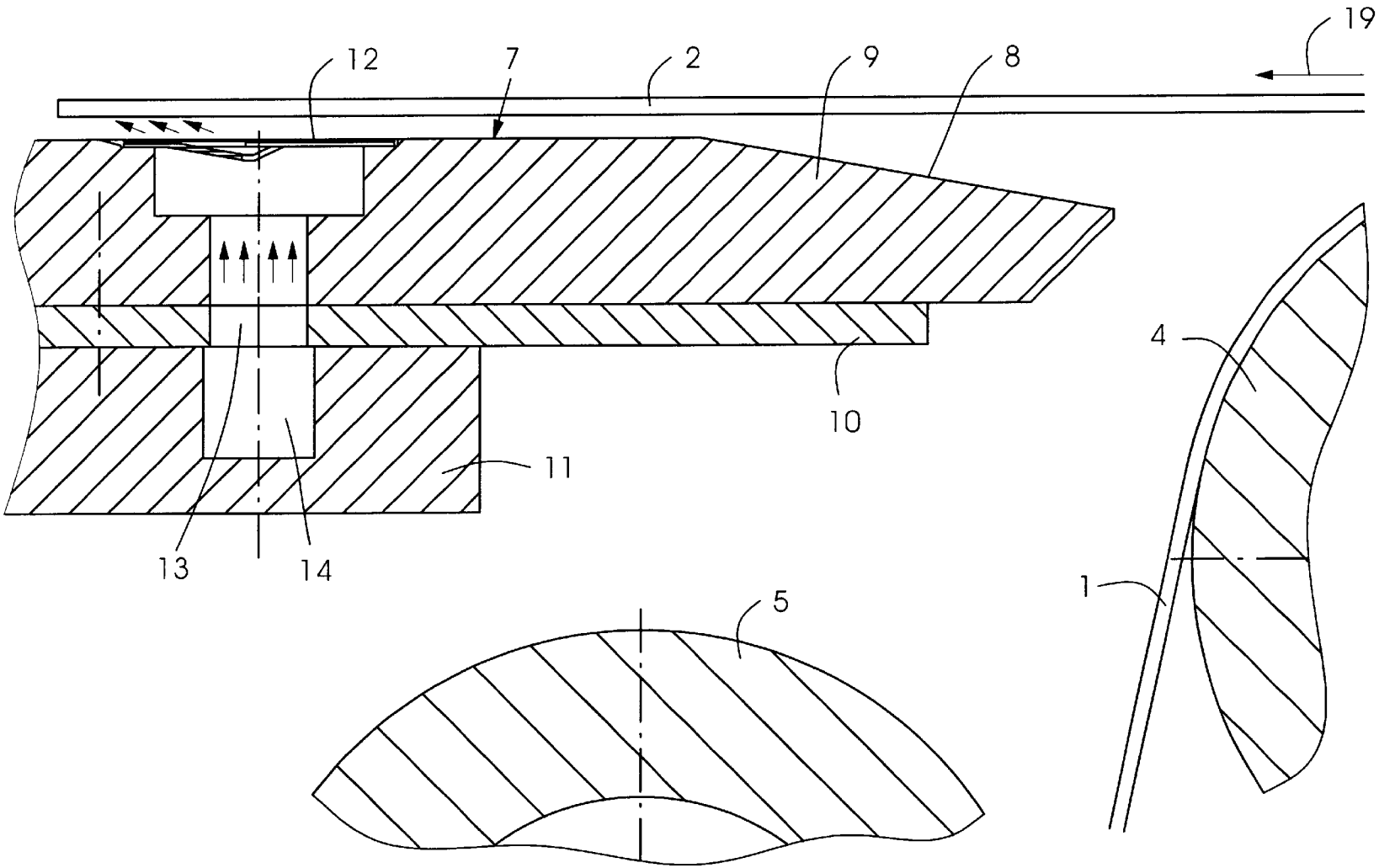
FIG. 3 is an enlarged fragmentary view of FIG. 1.

Referring now more specifically to the drawings and, first, particularly to FIGS. 1, 2 and 3 thereof, there is shown therein the basic structure of the drying station according to the invention in sectional views taken along different parallel planes. As these figures reveal, a conventional transport belt 1, which can be produced from plastic material, runs transversely through the drying station. Arranged on the transport belt 1 are printed sheets 2, which are fed to the drying station to be dried. Arranged above the transport belt 1 is an irradiation device 3 for irradiating the sheets 2. In the region of the irradiation device 3, the transport belt is guided over three deflection rollers 4, 5 and 6 which, together, form a deflection section, by which the distance of the transport belt 1 from the irradiation device 3 is increased. Furthermore, a cooling plate 7 is arranged in the region of the irradiation device 3, between the transport belt 1 and the irradiation device 3.

In addition, a number of details relating to the structure of the cooling plate 7 are ascertainable from FIGS. 1 to 3. In the region of the surface thereof, which faces towards the irradiation device 3, the cooling plate 7 is formed with a chamfer 8 and is made up of three layers 9, 10 and 11 extending horizontally. The uppermost layer 9, which faces towards the irradiation device 3, has blower nozzles 12 arranged in the surface thereof. The central layer 10 is formed with boreholes 13 in the region of the blower nozzles 12. Arranged in the lower layer 11 are air ducts 14 which are connected to the boreholes 13 and as a result also connected to the blower nozzles 12.

As is believed to be apparent, in particular, from FIG. 2, the uppermost layer 9 of the cooling plate 7 is provided, in addition to the blower nozzles 12, with a row of cooling ducts 15, through which a coolant 10 flows. The cooling plate 7 is supplied with coolant and with compressed air via lateral connections 16 and 17, which can serve at the same time as a holder for fixing the cooling plate 7.

Figure 4:
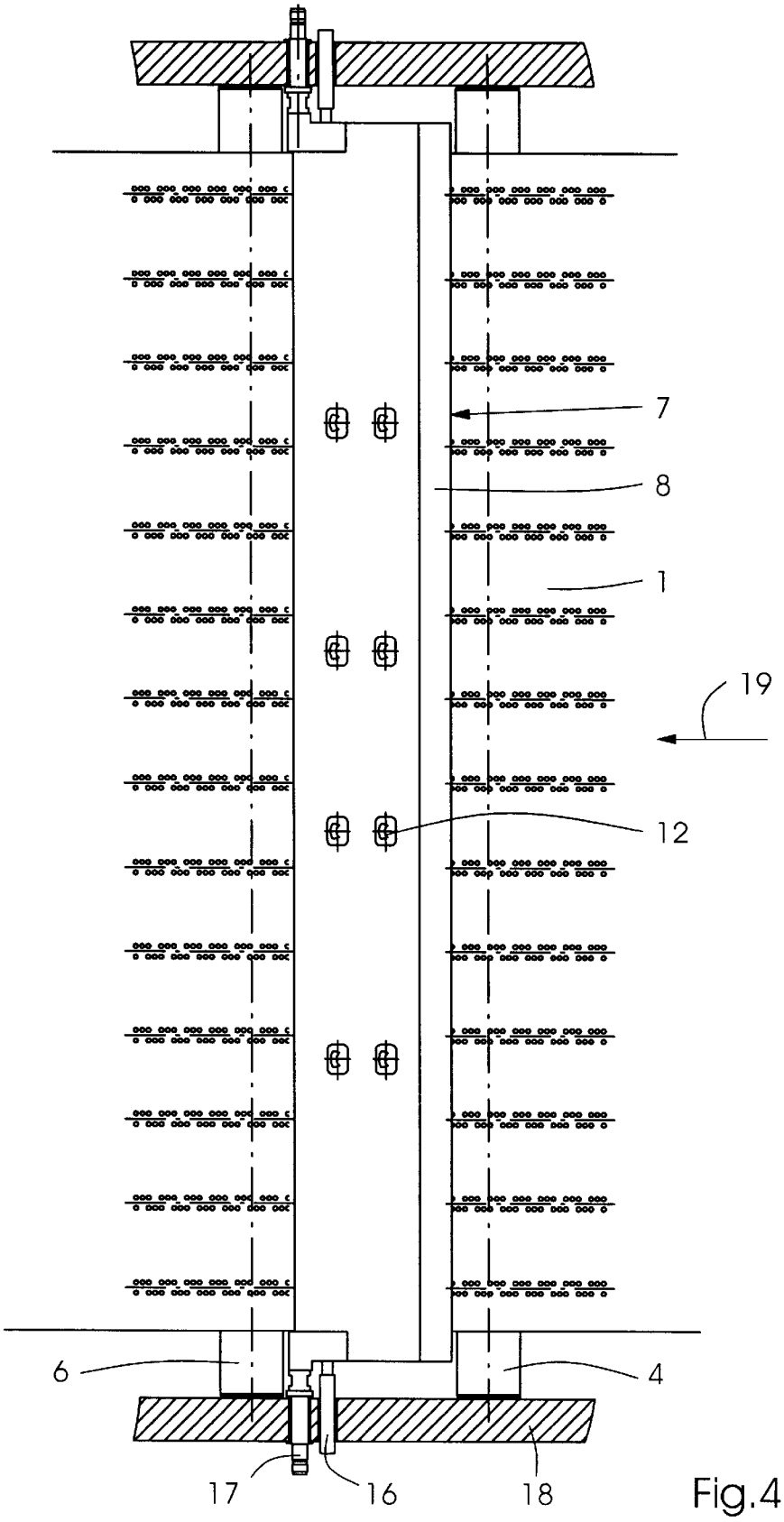
FIG. 4 is a top plan view of the drying station according to the invention, the plane of the view being rotated through 90° relative to the plane of the view illustrated in FIGS. 1 to 3.

The lateral distribution of the blower nozzles 12 on the cooling plates 7 is clearly shown in detail in FIG. 4. The sectional plane in this figure is illustrated so that as viewed from above, the cooling plate 7 and the transport belt 1 running underneath it are exposed. In the illustrated exemplary embodiment, the cooling plate 7 has a total of eight blower nozzles 12, which are, respectively, grouped in pairs, so that four pairs of blower nozzles 12 are arranged on the cooling plate 7, transversely to the direction of movement, represented by the arrow 19, of the transport belt 1. Arranged on both sides of the transport belt 1, is a side wall 18, respectively, through which the connections 16 and 17 for the compressed air and the coolant, respectively, are led, and wherein the deflection rollers 4, 5 and 6 are mounted.

Figure 5:
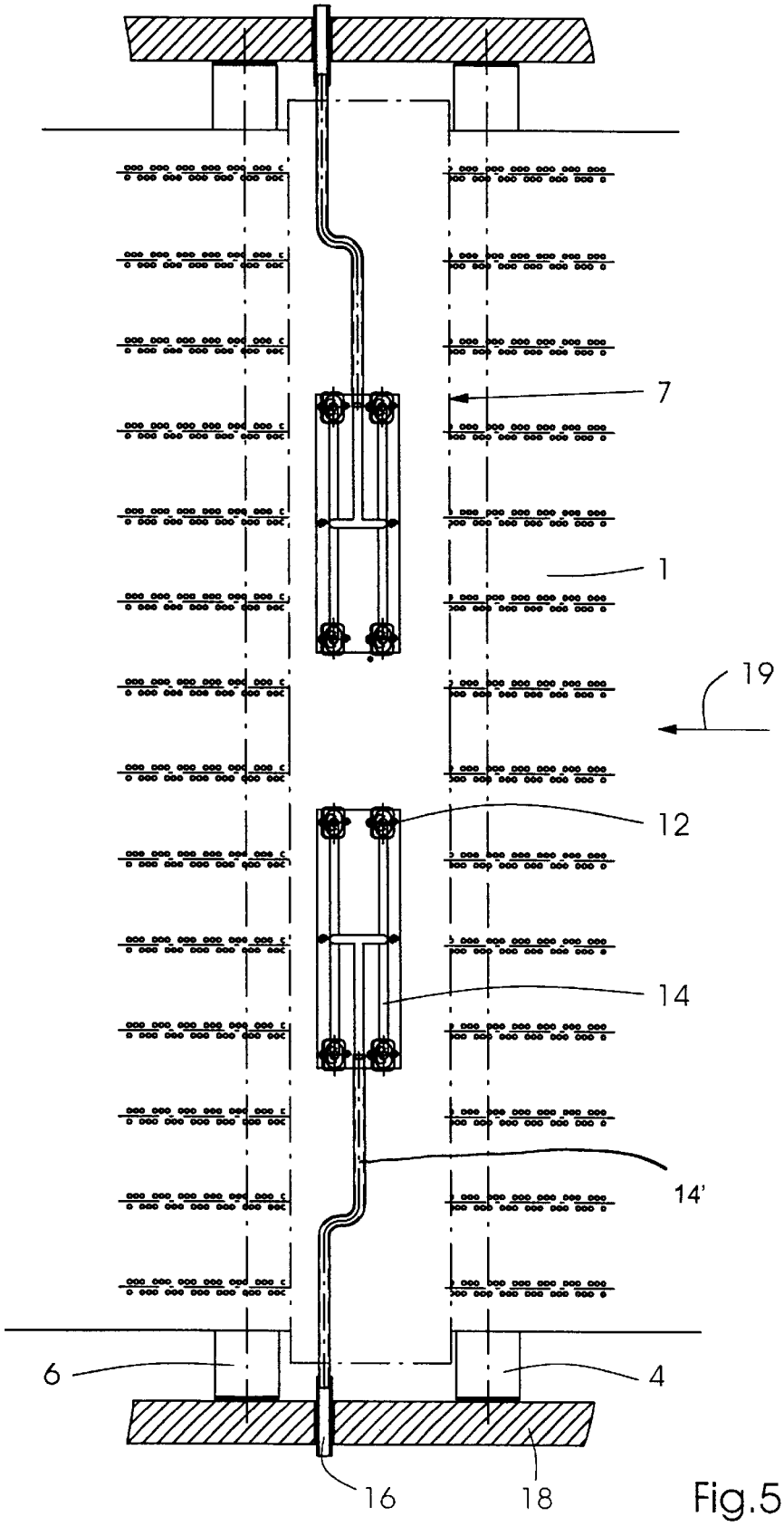
FIG. 5 is a view of the drying station according to the invention similar to that in FIG. 4, wherein air ducts thereof are shown.

The attachment of the blower nozzles 12 to a compressed-air supply by the air ducts 14 is illustrated in FIG. 5. As can be seen from FIG. 5, four blower nozzles 12, respectively, are interconnected by air ducts 14 and coupled to the connections 16 for the compressed air via a common air duct 14'.

Figure 6:
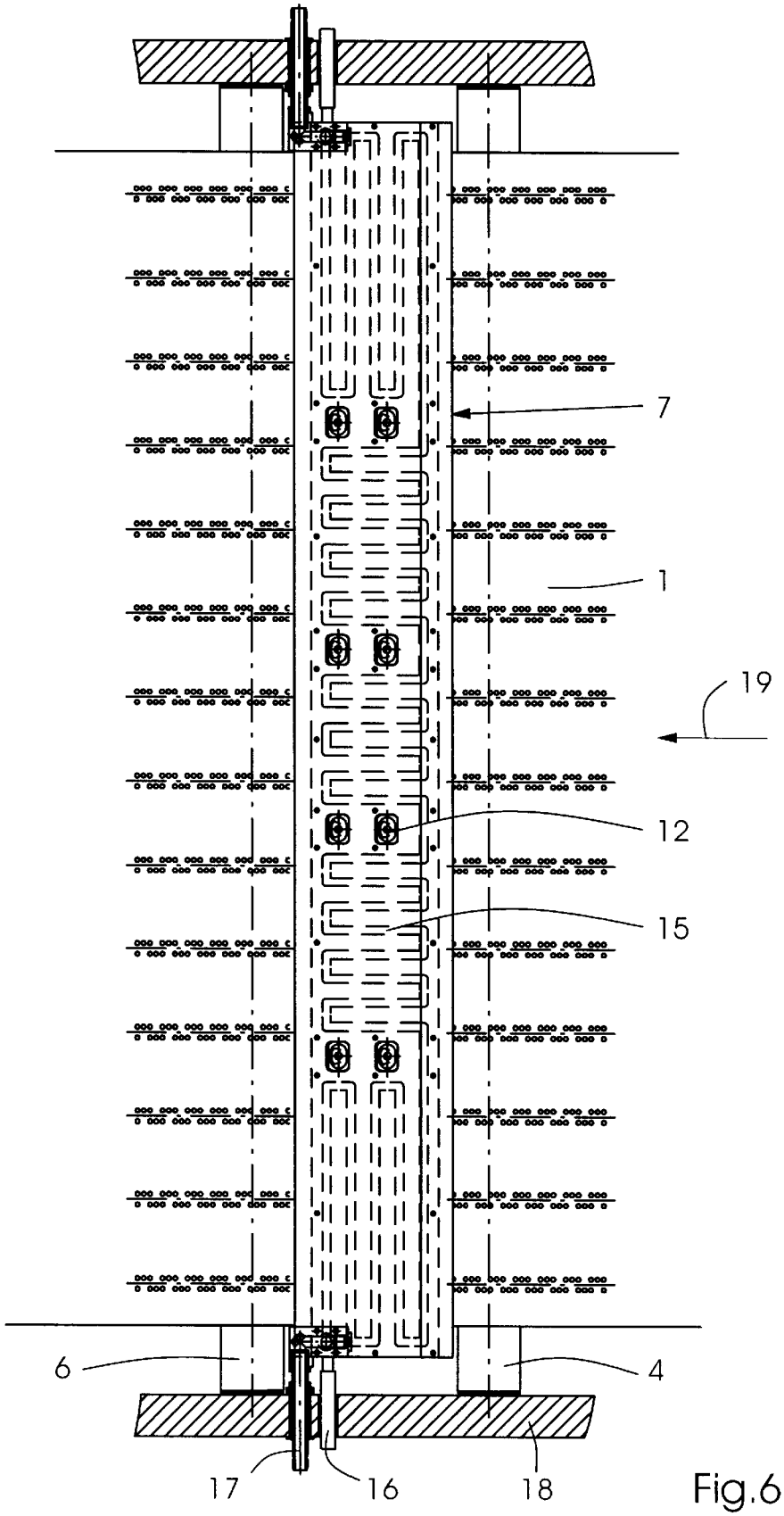
FIG. 6 is a view of the drying station according to the invention similar to that in FIG. 4, wherein coolant ducts thereof are shown.

A lateral arrangement of the cooling ducts 15 is illustrated in FIG. 6. The cooling ducts 15 pass through the uppermost layer 9 of the cooling plate 7 in a serpentine fashion and open laterally into the connections 17 for the coolant. This geometry makes efficient dissipation of the heat from the entire area of the cooling plate 7 possible. Because all of the duct sections are consecutively connected to one another in the illustrated exemplary embodiment, one could also speak of a single cooling duct 15. Depending upon the requirements on the cooling performance and the characteristics of the coolant, however, a plurality of continuous cooling ducts 15 can also be arranged in parallel with one another. A suitable coolant is water, for example.

As viewed in FIG. 1, the drying station according to the invention functions with the transport belt 1 passing through the plane of the drawing from the righthand to the lefthand side, respectively, as represented by the directional arrow 19. At the first deflection roller 4 arranged immediately in front of the cooling plate 7, the transport belt 1 is deflected downwardly. The deflection angle is selected so that the sheets 2 arranged on the transport belt 1 do not complete the deflection movement because of the inherent stiffness thereof, and as a result are lifted gradually off the transport belt 1. Because the sheets 2 are transported, in the interim, onward by the transport belt 1, the leading edge thereof encounters the cooling plate 7, i.e., the cooling plate 7 takes over the sheets 2 from the transport belt 1. In order to facilitate the transfer of the sheets 2 from the transport belt 1 to the cooling plate 7, the cooling plate 7 is formed with the chamfer 8 in the region thereof wherein the sheets 2 encounter the cooling plate 7. With the aid of the blower nozzles 12, the sheets 2 are guided on the cooling plate 7 and moved onwardly, and, in the process, are exposed to the radiation by the irradiation device 3.

The irradiation device 3 is operated continuously, so that the irradiation acts continuously on the surface of the sheets 2, a respective area of the sheets 2, predefined or prescribed by the optics of the irradiation device 3, being irradiated. The irradiated area of the sheets 2 generally has the form of a narrow strip extending transversely to the direction of movement of the sheets 2. The length of the strip to be irradiated must be selected at least sufficiently large enough for the complete printing width transversely with respect to the direction of movement of the sheets 2 to be irradiated. It is usual for the length of the strip to be set so that irradiation is performed over the entire width of the transport belt 1.

The width of the irradiated strip must not exceed the corresponding dimensions of the cooling plate 7, in order that reliable shielding of the transport belt 1 from the irradiation is ensured. Otherwise, the width of the irradiated strip is less critical, because the sheets 2 are moved parallel to the wide side of the strip and therefore complete irradiation of the sheets 2 is ensured, irrespective of the width of the irradiated strip.

When the radiation emitted by the irradiation device 3 strikes the printing ink which has been applied to the surface of the sheets 2, a chemical reaction, in particular crosslinking, is produced and considerably accelerated, respectively, so that the liquid or pasty printing ink cures within an extremely short time. The heat produced during the irradiation is dissipated by the cooling plate 7. This makes it possible to use an irradiation device 3 with a high power density. By using an irradiation device 3 of this type, a high drying performance can be achieved, so that a high sheet throughput is permitted.

While the sheets 2 are being moved over the cooling plate 7, the transport belt 1 is guided around the second deflection roller 5, which is arranged underneath the cooling plate 7. Finally, the transport belt 1 is further guided by the third deflection roller 6 arranged immediately following the cooling plate 7, as viewed in the belt-running direction, and then runs again approximately in the same direction of movement represented by the arrow 19 as before the deflection section. In the region of this third deflection roller 6, the transport belt 1 and the sheets 2 are guided together again, so that the sheets 2 can be supplied to further processes with the aid of the transport belt 1.

During the entire passage through the deflection section, the transport belt 1 is not exposed to any irradiation or, at most, to slight irradiation by the irradiation source 2, because the cooling plate 7 serves as a radiation shield.

Furthermore, the transport belt 1 is also protected against the increases in temperature often accompanying such irradiation processes, because the heat produced during the irradiation is dissipated by the cooling plate 7. In addition, indirect transfer of heat via the sheets 2 can be avoided to a great extent, because the sheets 2 rest on the cooling plate 7 during the irradiation, and therefore excessive heating of the sheets 2 is prevented.

I claim:

1. A drying station for drying printed sheets transported by a transport belt, the drying station comprising an irradiation device for irradiating the printed sheets, a deflection section located in vicinity of said irradiation device for guiding the transport belt away from said irradiation device, and a shielding device disposed between the transport belt and said irradiation device for shielding the transport belt against radiation from said irradiation device while the sheets are exposed to the radiation.

2. The drying station according to claim 1, wherein said deflection section has such dimensions that the sheets are lifted off the transport belt, at least in some regions, at a beginning of said deflection section.

3. The drying station according to claim 1, wherein said shielding device is formed with a chamfer.

4. The drying station according to claim 1, further comprising devices for guiding and for transporting the sheets, said guiding and said transporting devices being disposed on a side of said shielding device facing towards said irradiation device.

5. The drying station according to claim 4, further comprising blower nozzles disposed on said shielding device for guiding and for transporting the sheets.

6. The drying station according to claim 5, further comprising air ducts disposed in said shielding device and serving for supplying air to said blower nozzles.

7. The drying station according to claim 1, further comprising cooling ducts disposed in said shielding device and being traversible by a coolant flow.

8. The drying station according to claim 1, wherein said shielding device has a plate-shaped construction.

9. The drying station according to claim 8, wherein said shielding device is formed of three layers made up of a first layer facing towards said irradiation device, and being provided with blower nozzles and cooling ducts, a succeeding second layer serving as a closure plate for said cooling ducts being open towards said second layer, and a third layer provided with air ducts therein opening towards said second layer.

10. The drying station according to claim 9, wherein said second layer of said shielding device is formed with boreholes for passage of air from said air ducts of said third layer to said blower nozzles of said first layer.

11. The drying station according to claim 1, further comprising at least three deflection rollers disposed in said deflection section.

12. The drying station according to claim 1, wherein said irradiation source is a UV radiator.

13. A printing machine having a drying station for drying printed sheets transported by a transport belt, the printing machine comprising an irradiation device for irradiating the printed sheets, a deflection section located in vicinity of said irradiation device for guiding the transport belt away from said irradiation device, and a shielding device disposed between the transport belt and said irradiation device for shielding the transport belt against radiation from said irradiation device while the sheets are exposed to the radiation.

14. A method for drying printed sheets, which comprises:

conveying the sheets by a transport belt into the vicinity of an irradiation device;

separating the sheets from the transport belt, at least in some regions, before guiding the sheets past the irradiation device;

guiding the transport belt and guiding the sheets separated from the transport belt, past the irradiation device; and subjecting only the sheets to irradiation for accelerating drying thereof, while shielding the transport belt from the irradiation.

15. The method according to claim 14, which further comprises, in the vicinity of the irradiation device, guiding the transport belt over a deflection section.

16. The method according to claim 14, which further comprises, in the vicinity of the irradiation device, guiding the sheets over a shielding device for shielding the transport belt from the irradiation.

17. The method according to claim 14, which further comprises guiding the transport belt and the sheets together again after passing the irradiation device.

* * * * *